United States Patent [19]

Ishikawa

[11] Patent Number: 4,613,286

[45] Date of Patent: Sep. 23, 1986

[54] CONSTANT TORQUE CONTROL SYSTEM FOR A VARIABLE DISPLACEMENT PUMP OR PUMPS

[75] Inventor: Katsuji Ishikawa, Yokohama, Japan

[73] Assignee: Kabushiki Kaisha Komatsu Seisakusho, Tokyo, Japan

[21] Appl. No.: 687,798

[22] Filed: Dec. 31, 1984

[51] Int. Cl.[4] ..... F04B 49/00

[52] U.S. Cl. ..... 417/216; 417/218; 417/222; 60/447; 60/452

[58] Field of Search ..... 417/213, 216, 222, 218; 60/447, 452

[56] References Cited

U.S. PATENT DOCUMENTS

| | | | |
|---|---|---|---|
| 3,510,231 | 5/1970 | Bobst | 417/218 |
| 3,732,036 | 5/1973 | Busbey et al. | 417/222 X |
| 3,767,327 | 10/1973 | Wagenseil | 417/216 |
| 3,841,795 | 10/1974 | Ferre et al. | 417/216 |
| 3,897,174 | 7/1975 | Cappelle | 417/216 |
| 4,203,712 | 5/1980 | Uehara | 417/218 |
| 4,248,574 | 2/1981 | Uehara et al. | 417/216 |
| 4,498,847 | 2/1985 | Akiyama | 417/218 X |

FOREIGN PATENT DOCUMENTS

| | | | |
|---|---|---|---|
| 1453586 | 4/1969 | Fed. Rep. of Germany | 417/216 |
| 2513548 | 10/1976 | Fed. Rep. of Germany | 417/218 |
| 122104 | 10/1978 | Japan | 417/216 |
| 108002 | 8/1979 | Japan | 417/218 |
| 1478 | 1/1980 | Japan | 417/216 |
| 143179 | 9/1982 | Japan | 417/218 |
| 63384 | 4/1984 | Japan | 417/213 |

*Primary Examiner*—William L. Freeh
*Assistant Examiner*—Paul F. Neils
*Attorney, Agent, or Firm*—Armstrong, Nikaido, Marmelstein & Kubovcik

[57] ABSTRACT

A control system for a variable displacement pump or pumps driven by a vehicular engine for supplying pressurized fluid to implement actuators via implement control valves. Included is a servomechanism comprising a servoactuator section coupled to each variable displacement pump for varying the per cycle displacement thereof, a servovalve section for operating the servoactuator section by fluid pressure from a fixed displacement pump, and a control section for actuating the servovalve section. The servomechanism control section has a control piston displaced by variable fluid pressures from the variable displacement pumps against the effect of at least two springs. The springs are so arranged that their spring constant changes as the control piston travels to a predetermined position intermediate the opposite extreme positions thereof, in order to make possible the constant torque control of each variable displacement pump for the effective use of the engine output horsepower.

8 Claims, 4 Drawing Figures

CONSTANT TORQUE CONTROL SYSTEM FOR A VARIABLE DISPLACEMENT PUMP OR PUMPS

BACKGROUND OF THE INVENTION

This invention relates to a fluid operated control system for a variable displacement pump or pumps driven by a prime mover such as an internal combustion engine. More particularly, the invention is directed to a system for controlling the per cycle displacement of a pump or pumps supplying fluid under pressure to implement actuators, as in a materials handling vehicle such as an excavator, in accordance with the load being imposed on the pump or pumps.

The use of variable displacement pumps is common in earth movers or like vehicles for powering various implement actuators on such vehicles. A constant torque control of the variable displacement pumps makes possible the most effective use of the output horsepower of the engine driving the pumps. Typical of known methods for the constant torque control of the pumps is the one wherein the pump displacement is controlled by the resultant of the delivery pressure of the pumps and the force of a spring or springs opposing the pump pressure.

The prior art devices constructed in accordance with the above constant torque control method have had in common the weakness that the spring means for providing the force required for controlling pump displacement are too bulky for the provision of compact pump control devices desired today. Such bulky spring means give rise to additional drawbacks such as great hysteresis and fluctuations in control performance. Pumps have been growing smaller and smaller in recent years by virtue of advancements in materials and design engineering. However, as the pump control devices have not been reduced in size because of the bulky spring means, neither have been the pump assemblies incorporating such devices.

SUMMARY OF THE INVENTION

The present invention defeats the above noted weaknesses of the prior art and makes it possible to effect constant torque control of a variable displacement pump or pumps with a simple, lightweight, and compact apparatus. Particularly when adapted for controlling two or more pumps, the invention makes it possible to control the displacement of each pump in accordance with the sum of the delivery pressures of the pumps for the most efficient use of the output torque of the prime mover driving the pumps.

Basically, the invention provides a constant torque control system for at least one variable displacement pump operating under a variable load, having a fixed displacement pump supplying fluid under pressure to a servomechanism for varying the displacement of the variable displacement pump. The servomechanism broadly comprises a servoactuator section for acting directly on the variable displacement pump for varying the displacement thereof, a servovalve section for controlling fluid pressure communication between the fixed displacement pump and the servoactuator section, and a control section for controllably actuating the servovalve section in response to the variable output fluid pressure of the variable displacement pump.

The servoactuator section of the servomechanism has a servopiston slidably mounted in a servomechanism housing so as to define a pair of opposed fluid chambers and operatively coupled to the varyable displacement pump for varying its displacement in response to fluid pressure suppled to the fluid chambers. Resilient means act on the servopiston to cause the same to normally hold the variable displacement pump at a maximum displacement. The servovalve section has a servovalve spool slidably mounted in the servomechanism housing for selectively placing the pair of fluid chambers of the servoactuator section in and out of communication with the fixed displacement pump and with a fluid drain. The control section comprises control piston means also reciprocably mounted in the servomechanism housing for displacement in a first direction in response to the variable output fluid pressure of the variable displacement pump, and multiple spring means for biasing the control piston means in a second direction, opposite to the first direction, and normally holding the control piston means in an extreme position in the second direction. The multiple spring means has at least two springs adapted to vary the total spring constant thereof when the control piston means passes a predetermined position intermediate the opposite extreme positions thereof in the first and second directions.

Also included in the servomechanism is a control lever having a pair of opposite ends operatively engaged with the servopiston of the servoactuator section and with the servovalve spool of the servovalve section and medially pivoted to the control piston means of the control section. The control lever functions to move the servovalve spool in response to the movement of the control piston means, thereby causing displacement of the servopiston in response to fluid pressure that is fed from the fixed displacement pump via the servovalve section, and further to feed back the displacement of the servopiston to the servovalve spool, thereby controlling the displacement of the variable displacement pump in accordance with the variable fluid pressure output thereof.

The multiple spring means take the form of two helical compression springs concentrically nested one within the other in one preferred embodiment of the invention. The outer spring constantly acts on the control piston means to bias the same in the second direction regardless of the position thereof. The inner spring acts on the control piston means to bias the same in the second direction in coaction with the outer spring when the control piston means travels to and past the predetermined position in the first direction. In another preferred embodiment, the multiple spring means comprises two helical compression springs arranged collinearly with each other, with a movable spring seat interposed therebetween for movement into and out of abutment against a stop. The two collinear springs conjointly resist the travel of the control piston means in the first direction until the control piston means reaches the predetermined position, where the movable spring seat butts on the stop. When the control piston means travels past the predetermined position in the first direction, only one of the springs acts to resist such travel of the control piston means.

The multiple spring means of the above configurations make it possible to control the displacement of the variable displacement pump with a desired constant torque curve, with the size of the servomechanism reduced to a minimum.

For simultaneously controlling two or more variable displacement pumps, the servomechanism of the above construction may be provided for each pump. Each servomechanism responds to the resultant of the output fluid pressures of all the variable displacement pumps to control the displacement of one associated pump for the utmost use of the engine output.

The above and other features and advantages of this invention and the manner of realizing them will become more apparent, and the invention itself will best be understood, from a study of the following description and appended claims, with reference had to the attached drawings showing the preferred embodiments of the invention.

DESCRIPTION OF THE PREFERRED EMBODIMENTS

Figure 1:
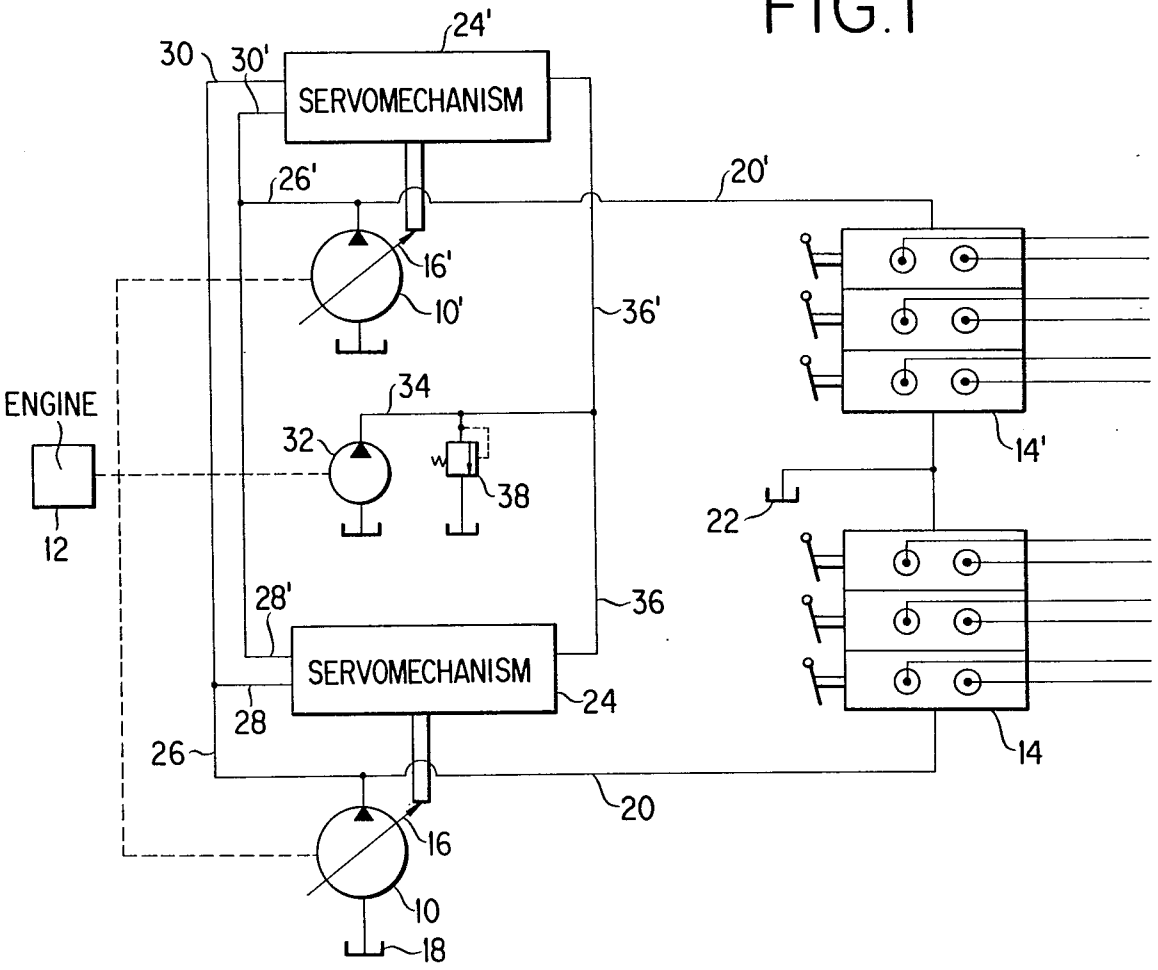
FIG. 1 is a diagrammatic representation of the general organization of the constant torque control system embodying the principles of the present invention, the control system being herein shown adapted for controlling two variable displacement pumps driven by a common internal combustion engine.

The general organization of the constant torque control system in accordance with this invention will be best understood from a consideration of FIG. 1. This figure shows the control system as adapted for use in an earth mover having two variable displacement pumps 10 and 10′ driven by a prime mover such as an internal combustion engine 12 for supplying fluid pressure to two groups of implement actuators, not shown, via respective groups of implement control valves 14 and 14′. Both pumps 10 and 10′ can be of conventional design having, for example, swash plates 16 and 16′. A change in the angular position of these swash plates results in a change in the per cycle displacement of the pumps 10 and 10′.

The first variable displacement pump 10 draws fluid, preferably hydraulic oil, from a reservoir or sump 18 and supplies it under pressure to the first group of implement control valves 14 by way of a supply conduit 20. Each in the form of a three position, directional control valve, the implement control valves 14 function under the vehicle operator's control to selectively place the pump 10 in communication with the associated implement actuators and with a fluid drain indicated at 22. The second variable displacement pump 10′ is likewise connected to the second group of similar implement control valves 14′ by way of a supply conduit 20′. The implement control valves 14′ also operate under the vehicle operator's control to selectively place the second pump 10′ in communication with the associated implement actuators and with the fluid drain 22.

For controlling the displacement of the pumps 10 and 10′ there are provided servomechanisms 24 and 24′ of like construction which operate the swash plates 16 and 16′ of the pumps. Each servomechanism responds to fluid pressures from both pumps 10 and 10′. Thus the first pump 10 communicates with both servomechanisms 24 and 24′ by way of a conduit 26 and branch conduits 28 and 30, whereas the second pump 10′ communicates with both servomechanisms by way of a conduit 26′ and branch conduits 28′ and 30′.

Also in communication with both servomechanisms 24 and 24′ is a fixed displacement pump 32 of smaller capacity than the variable displacement pumps 10 and 10′. Driven by the engine 12, the fixed displacement pump 32 delivers fluid under pressure to both servomechanisms 24 and 24′ by way of a conduit 34 and branch conduits 36 and 36′. The conduit 34 has a relief valve 38 for bleeding off excess pressure from the fixed displacement pump 32. The fluid pressure thus delivered from fixed displacement pump 32 to servomechanisms 24 and 24′ is to be used for the controlled actuation of the swash plates 16 and 16′ of the variable displacement pumps 10 and 10′, as will become more clearly understood from the following description of the servomechanisms.

Figure 2:
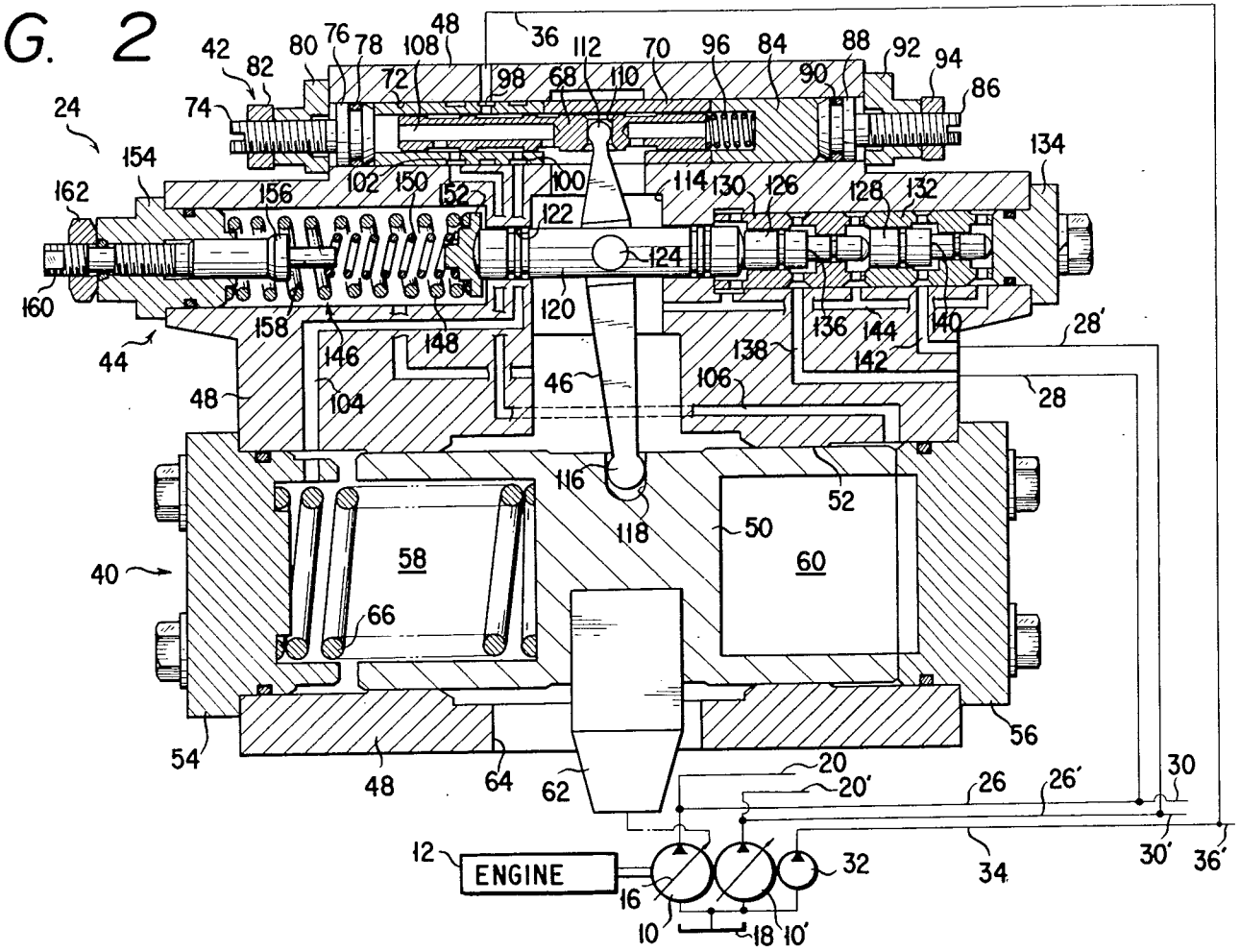
FIG. 2 is a detailed sectional representation of one of the two servomechanisms used in the control system of FIG. 1, shown together with the two variable displacement pumps and one fixed displacement pump, the other servomechanism being of like construction.

Given hereafter, with reference directed primarily to FIG. 2, is a more extensive discussion of the above constant torque control system, and particularly of the servomechanisms 24 and 24′, the major components of the control system. Since the two variable displacement pumps 10 and 10′ are controlled in a like manner, and since the two servomechanisms 24 and 24′ are of like construction, FIG. 2 shows only one servomechanism 24 in its working relationship with the pumps 10, 10′ and 32. Only the servomechanism 24 will therefore be described in detail, it being understood that the same description applies to the other servomechanism 24′.

The representative servomechanism 24 broadly comprises:

1. A servoactuator section 40 for changing the displacement of the variable displacement pump 10 by acting directly on its swash plate 16.
2. A servovalve section 42 for controlling fluid pressure communication between fixed displacement pump 32 and servoactuator section 40.
3. A control section 44 for actuating the servovalve section 42 in response to fluid pressures from both variable displacement pumps 10 and 10′.

Perhaps extraneous to all these sections 40, 42 and 44 but still forming a part of the servomechanism 24 is a control lever 46 which serves to interrelate the operations of those sections. An additional constituent of the servomechanism 24 is a housing 48 which is common to all its sections 40, 42 and 44.

The servoactuator section 40 of the servomechanism 24 has a servopiston 50 slidably fitted in a bore 52 in the housing 48. Closing the opposite ends of the bore 52, a pair of end covers 54 and 56 coact with the servopiston 50 to define a pair of fluid chambers 58 and 60 on the opposite sides of the servopiston. The servopiston 50 has an actuator arm 62 embedded therein and projecting out of the servomechanism housing 48 through a slot 64 defined therein. The projecting end of the actuator arm 62 is operatively coupled to the swash plate 16 of the variable displacement pump 10, in such a manner that the linear travel of the servopiston 50 within the bore 52 results in a change in the per cycle displacement of the pump 10. The linear travel of the servopiston 50 takes place as the opposed fluid chambers 58 and 60 are selectively placed in and out of communication with the fixed displacement pump 32 by the servovalve section 42. A helical compression spring 66 acts between servopiston 50 and left hand end cover 54 to bias the former toward the extreme right hand position in which the servopiston is shown. Normally retained in this extreme right hand position under spring pressure, the servopiston 50 holds the variable displacement pump 10 at maximum displacement.

For the selective delivery of the pressurized fluid from the fixed displacement pump 32 to the pair of opposed fluid chambers 58 and 60 of the servoactuator section 40, the servovalve section 42 of the servomechanism 24 has a spool 68 slidably received in a guide sleeve 70. This guide sleeve is closely fitted in a bore 72 in the servomechanism housing 48, with the bore 72 extending parallel to the bore 52 of the servoactuator section 40. The left hand end of the guide sleeve 70 is held against an adjusting screw 74 via a slidable abutment 76 having an O ring seal 78. The adjusting screw 74 extends through, and is threadedly engaged with, an end cover 80 closing the left hand end of the bore 72 and has a locknut 82 fitted thereon. The right hand end of the guide sleeve 70, on the other hand, butts on a slidable spring seat 84, which in turn is held against an adjusting screw 86 via a slidable abutment 88 having an O ring seal 90. The adjusting screw 86 likewise extends through an end cover 92 closing the right hand end of the bore 72 and has a locknut 94 engaged thereon. Mounted between servovalve spool 68 and spring seat 84, a helical compression spring 96 is intended to prevent looseness among control lever 46, servopiston 50, and servovalve spool 68 which are interengaged in a manner yet to be described.

The guide sleeve 70 of the servovalve section 42 has an inlet port 98 and two outlet ports 100 and 102 formed radially therein. The inlet port 98 communicates with the fixed displacement pump 32 by way of the conduits 34 and 36. The outlet ports 100 and 102 communicate with the opposed fluid chambers 58 and 60 of the servoactuator section 40 by way of passageways 104 and 106, respectively, in the servomechanism housing 48. The servovalve spool 68 functions to selectively place the inlet port 98 in and out of communication with the outlet ports 100 and 102. The servovalve spool 68 has formed therein an axial bore 108 to provide a drain passageway to be selectively placed in and out of communication with the outlet ports 100 and 102.

The servovalve spool 68 is further recessed medially at 110. Pivotably and slidably engaged in this recess 110 is one end 112 of the control lever 46 extending with clearance through a recess 114 in the servomechanism housing 48 so as to extend between the bores 52 and 72 therein. The other end 116 of the control lever 46 in similarly engaged in a recess or socket 118 in the servopiston 50 of the servoactuator section 40. The control lever 46 activates the servovalve spool 68 by being itself actuated by means in the control section 44, as well as by the servopiston 50 of the servoactuator section 40, in a manner to be detailed subsequently.

Normally, the servovalve spool 68 lies in the illustrated position, holding the inlet passageway 98 out of communication with the outlet passageway 102. The servopiston 50 of the servoactuator section 40 is therefore held in the illustrated maximum displacement position under the bias of the compression spring 66. On actuation, then, the servovalve spool 68 selectively communicates the inlet passageway 98 with the outlet passageways 100 and 102. The servopiston 50 will then travel in a desired direction under fluid pressure from the fixed displacement pump 32.

Intended to actuate the servovalve spool 68 via the control lever 46, the control section 44 has a control piston 120 slidably received in a bore 122 defined in the servomechanism housing 48 so as to extend parallel to the bores 52 and 72. The control lever 46 is medially coupled to the control piston 120 via a pivot pin 124. The control piston 120 has its right hand end held against a first biasing piston 126 and thence against a second biasing piston 128, which biasing pistons are in axial alignment with the control piston 120 and slidably received in respective guide sleeves 130 and 132. The second biasing piston 128 normally butts on an end cover 134 closing the right hand end of the bore 122. The first biasing piston 126 has an annular shoulder 136 to bear the variable fluid pressure fed from the first variable displacement pump 10 via the conduits 26 and 28 and a passageway 138 in the servomechanism housing 48. The second biasing piston 128 also has an annular shoulder 140 to bear the variable fluid pressure fed from the second variable displacement pump 10' via the conduits 26' and 28' and a passageway 142 in the servomechanism housing 48. At 144 is seen a drain passageway associated with the biasing pistons 126 and 128.

Arranged next to the left hand end of the control piston 120 are multiple spring means 146 constituting a feature of this invention. In this particular embodiment, the multiple spring means 146 has a first 148 and a second 150 helical compression springs of coaxial arrangement with the control piston 120, with the second compression spring 150 concentrically nested within the first compression spring 148. Both first 148 and second 150 compression springs have their right hand ends held against a common spring seat 152 on the left hand end of the control piston 120. The first compression spring 148 has its left hand end seated against an end cover 154 closing the left hand end of the bore 122 by being screwed or otherwise fastened to the servomechanism housing 48. Thus the first compression spring 148 normally holds the control piston 120 in its extreme right hand position, as shown, with the second biasing piston 128 butting against the right hand end cover 134. As required, a shim pack or the like may be installed between the mating surfaces of servomechanism housing 48 and end cover 154 for the adjustment of the force of the first compression spring 148 resisting the leftward travel of the control piston 120.

While the first compression spring 148 constantly acts to bias the control piston 120 rightwardly, the second compression spring 150 starts resisting the leftward travel of the control piston 120 only when the latter travels leftwardly to a predetermined position intermediate the opposite extreme positions thereof. Accordingly, the total spring constant of the two compression springs 148 and 150 changes when the control piston 120 reaches the predetermined intermediate position. considerably less in free axial length than the first compression spring 148, the second compression spring 150 is arranged for movement into and out of abutment against a spring seat 156. A guide core 158 projects rightwardly from the spring seat 156 and is loosely received in the second compression spring 150 for guiding the movement thereof into and out of abutment against the spring seat 156. This spring seat 156 is itself adjustably movable toward and away from the control piston 120 by an adjusting screw 160 threadedly extending through and projecting outwardly of the end cover 154, for correspondingly varying the predetermined intermediate position of the control piston 120 where the total spring constant of the compression springs 148 and 150 changes. A locknut 162 is fitted over the projecting end of the adjusting screw 160.

Operation

Figure 3:
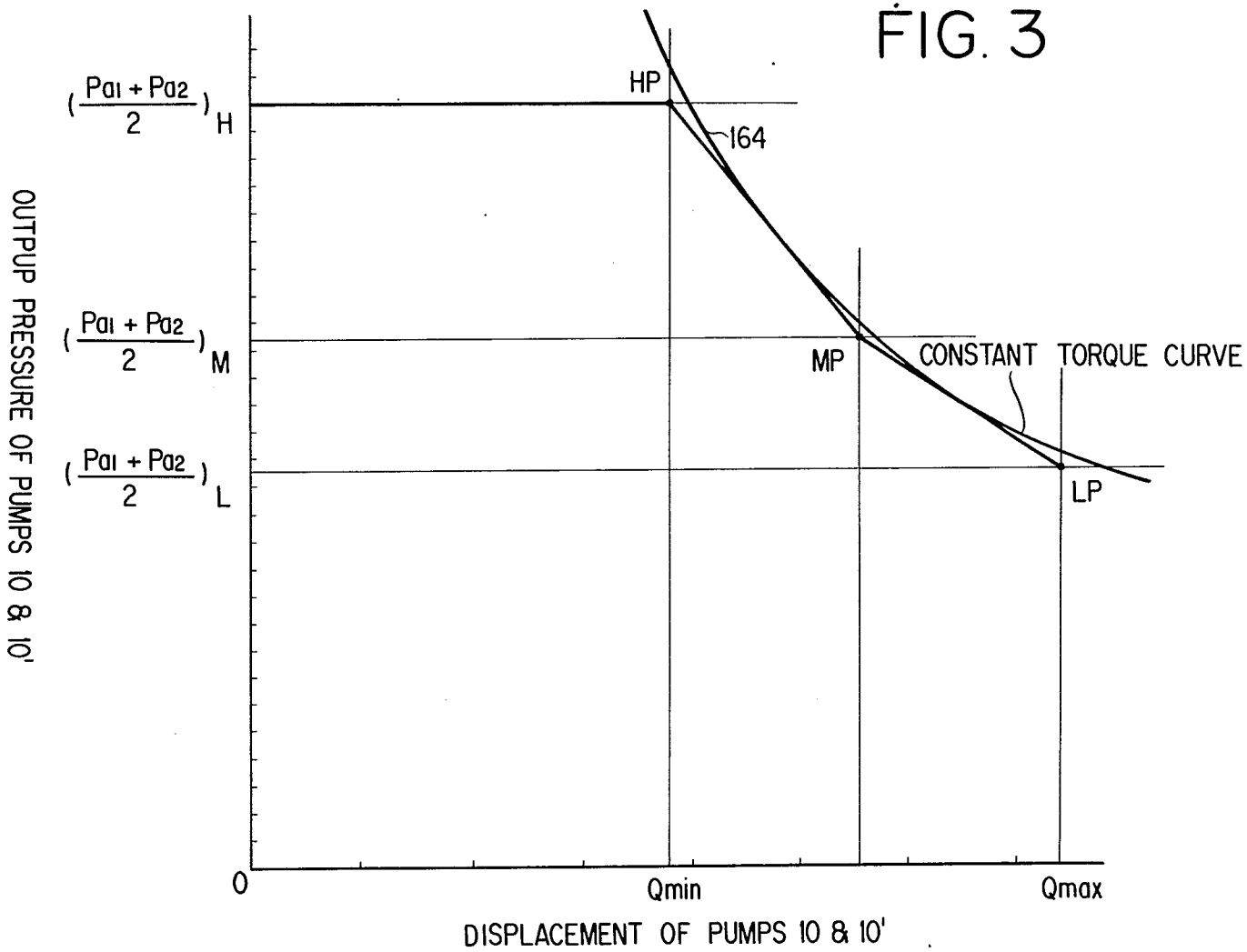
FIG. 3 is a graph plotting the curve of the output fluid pressure of each variable displacement pump against its rate of delivery, as controlled by the control system of FIG. 1.

The operation of the constant torque control system of FIGS. 1 and 2 will be better understood by referring also to FIG. 3 graphically representing the pressure-displacement characteristic of each variable displacement pump 10 or 10′ under the control of that system.

Normally, or when all the implement control valves 14 and 14′ are in neutral, with no load on the variable displacement pumps 10 and 10′, the fluid pressure from these pumps does not cause displacement of the control piston 120 of the control section 44 of the servomechanism 24 (or of the other servomechanism 24′) against the force of the compression spring 148 of the multiple spring means 146. The control piston 120, as well as the biasing pistons 126 and 128, is in the illustrated extreme right hand position, holding the spool 68 of the servovalve section 42 also in the illustrated extreme right hand position. The pressurized fluid from the fixed displacement pump 32 is then directed into the left hand fluid chamber 58 of the servoactuator section 40 through the conduits 34 and 36, the inlet port 98 and outlet port 100 of the servovalve section, and the passageway 104 in the servomechanism housing 48. The right hand fluid chamber 60 of the servoactuator section 40 communicates with the fluid drain by way of the passageway 106 in the servomechanism housing 48 and the port 102 and drain passageway 108 of the servovalve section 42. With the servopiston 50 of the servoactuator section 40 thus held in the illustrated extreme right hand position, the variable displacement pump 10 is at a maximum displacement Qmax.

When any one or more of the implement control valves 14 and 14, in either or both of the two groups of such valves, are hand actuated to operate the corresponding one or ones of the unshown implement actuators, the output pressure of one or both of the variable displacement pumps 10 and 10′ will rise, exerting a leftward force on either or both of the biasing pistons 126 and 128 of the control section 44 of the servomechanism 24 in opposition to the force of the first compression spring 148 of the multiple spring means 146.

Let Pa1 be the output pressure of the first variable displacement pump 10, and Pa2 the output pressure of the second variable displacement pump 10′. Then, until the mean output pressure $(Pa1+Pa2)/2$ of the pumps 10 and 10′ builds up to $[(Pa1+Pa2)/2]_L$, the control piston 120 of the servomechanism control section 44 will travel to the left against the bias of the first compression spring 148 of the multiple spring means 146 under the fluid pressure acting on either or both of the biasing pistons 126 and 128. The control lever 46 will transmit such leftward travel of the control piston 120 to the spool 68 of the servovalve section 42. The consequent leftward travel of the servovalve spool 68 will result in a reduction in the cross sectional area of the fluid passageway from inlet port 98 to outlet port 100. The servovalve spool 68 will block the communication of the inlet port 98 with both outlet ports 100 and 102 when the mean output pressure of the pumps 10 and 10′ builds up to $[(Pa1+Pa2)/2]_L$.

With a continued increase in the output pressure of the pump 10 and/or pump 10′, the control piston 120 will further travel leftwardly against the force of the compression spring 148, resulting in the simultaneous leftward travel of the servovalve spool 68. Then the servovalve spool 68 will place the inlet port 98 in communication with the outlet port 102 and will place the other outlet port 100 in communication with the drain passageway 108. Thus the servovalve section 42 will direct the pressurized fluid from the fixed displacement pump 32 toward the right hand fluid chamber 60 of the servoactuator section 40 by way of the passageway 106 and communicate the left hand fluid chamber 58 with the fluid drain by way of the passageway 104. The result will be the leftward travel of the servopiston 50 against the force of the compression spring 66, causing a decrease in the displacement of the variable displacement pump 10.

Upon leftward travel of the servopiston 50, the control lever 46 will be pivoted in a clockwise direction about its pivot pin 124 on the control piston 120 and will so cause rightward displacement of the servovalve spool 68, thereby feeding back the displacement of the servopiston 50 to the servovalve spool 68. Therefore, when the servopiston 50 reaches a position corresponding to the total output pressure of the variable displacement pumps 10 and 10′, the servovalve spool 68 will place the inlet port 98 out of communication with both outlet ports 100 and 102. The variable displacement pump 10 will thus be held at a displacement corresponding to the total output pressure of the variable displacement pumps 10 and 10′ at that time.

Until the mean output pressure of the variable displacement pumps 10 and 10′ builds up to $[(Pa1+Pa2)/2]_M$ in the graph of FIG. 3, the control piston 120 of the control section 44 will travel leftwardly only against the force of the first compression spring 148 of the multiple spring means 146, and the servomechanism will operate to control the diplacement of the variable displacement pump 10 to suit the total output pressure of both variable displacement pumps 10 and 10′.

When the mean output pressure of the variable displacement pumps 10 and 10′ rises to $[(Pa1+Pa2)/2]_M$, the control piston 120 will reach the aforesaid predetermined position intermediate the opposite extreme positions thereof. Then the distance between the spring seat 152 and 156 will become equal to the free axial dimension of the second compression spring 150 of the multiple spring means 146. Consequently, with a further increase in the total output pressure of the variable displacement pumps 10 and 10′, the control piston 120 will travel leftwardly against the combined forces of both compression springs 148 and 150 of the multiple spring means 146, causing a simultaneous leftward travel of the servovalve spool 68. The servovalve section 42 will then place the the right hand fluid chamber 60 of the servoactuator section 40 in communication with the fixed displacement pump 32, and the left hand fluid chamber 58 in communication with the fluid drain. The resulting leftward travel of the servopiston 50 will cause a decrease in the displacement of the variable displacement pump 10. Also, with such leftward travel of the servopiston 50, the control lever 46 will be pivoted in a clockwise direction to move the servovalve spool 68 rightwardly against the force of the compression spring 96. Thus, when the servopiston 50 reaches a position corresponding to the total output pressure of the variable displacement pumps 10 and 10′, the servovalve section 42 will close both fluid chambers 58 and 60 of the servoactuator section 40. The variable displacement pump 10 will then be held at a displacement corresponding to the total output pressure of both variable displacement pumps 10 and 10'.

When the mean output pressure of the variable displacement pumps 10 and 10' further rises to $[(Pa1+Pa2)/2]_H$, the maximum, the servopiston 50 will hit the left hand end cover 54 and will reduce the displacement of the variable displacement pump 10 to a minimum Qmin.

The operation of the servomechanism 24 when the total output pressure of the variable displacement pumps 10 and 10' decreases will be understood from the foregoing description.

As is apparent from the above, only the first compression spring 148 of the multiple spring means 146 resists the leftward travel of the control piston 120 from point LP to point MP in the graph of FIG. 3. From point MP to point HP, both compression springs 148 and 150 of the multiple spring means 146 combinedly resist the leftward travel of the control piston 120. Therefore, by suitably selecting the spring constants of these compression springs 148 and 150, the displacement of the variable displacement pump 10, can be controlled along the constant torque curve 164 of FIG. 3 which is tangent to the two straight lines LP-MP and MP-HP. It will also be seen that the constant torque curve, as well as the points LP, MP and HP, is variable by changing the springs of the multiple spring means 146. The intermediate point MP, in particular, is readily variable by revolving the adjusting screw 160 into or out of the end cover 154.

As an additional advantage, the constant torque control system of this invention is applicable to two or more variable displacement pumps positioned at a distance from each other. The pumps will be controlled in a hydraulically interlocked manner, to provide the same pressure-displacement characteristic.

SECOND FORM

Figure 4:
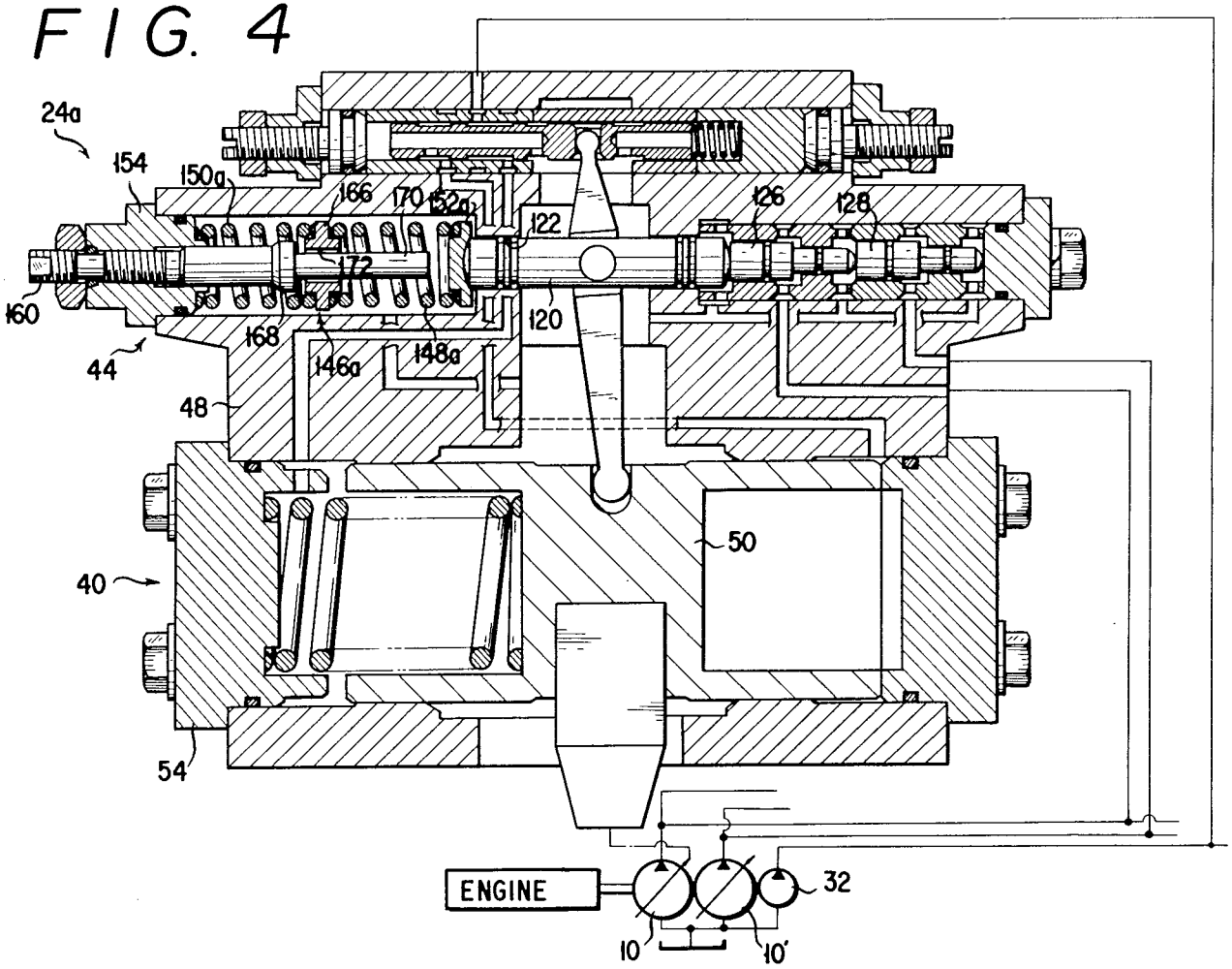
FIG. 4 is a view similar to FIG. 2 but showing a modified servomechanism for use in the control system of the present invention.

In FIG. 4 is shown a modified servomechanism **24*a* for use in the constant torque torque control system of FIG. 1 in substitution for each servomechanism 24, 24'. The modified servomechanism 24*a* features multiple spring means 146*a*, included in its control section 44, which differ in both construction and operation from the multiple spring means 146 of the servomechanism 24 or 24'**.

The multiple spring means **146*a* comprises first 148*a* and second 150*a* helical compression springs of collinear arrangement with respect to each other and of coaxial arrangement with respect to the control piston 120. The first compression spring 148*a* has one end held against the control piston 120 via a spring seat 152*a* and another end held against a floating spring seat 166 movable relative to the servomechanism housing 48 in the axial direction of the springs 148*a* and 150*a*. The second compression spring 150*a* has one end held against the floating spring seat 166 and another end held against the end cover 154 closing the left hand end of the bore 122 in the servomechanism housing 48. Normally holding the control piston 120 in its extreme right hand position, the first spring 148*a* and second spring 150*a* coact to resist the leftward travel of the control piston under fluid pressure from the variable displacement pumps 10 and 10'**.

Also included in the modified multiple spring means **146*a* is a stop or abutment 168 disposed within the second compression spring 150*a*. The floating spring seat 166 is to butt on the stop 168 when the control piston 120 travels leftwardly against the forces of the compression springs 148*a* and 150*a* to a predetermined position intermediate the opposite extreme positions thereof. The stop 168 has a guide core 170 projecting therefrom toward the control piston 120 and loosely extending through a hollow 172 in the floating spring seat 166 for guiding the linear reciprocation thereof with the deflection of the compression springs 148*a* and 150*a*. Extending through and threadedly engaged with the end cover 154, the adjusting screw 160 is used in this embodiment for adjustably varying the position of the stop 168 toward and away from the control piston 120**.

The modified servomechanism **24*a* can be identical in the other details of construction with the servomechanism 24 of FIG. 2. The constant torque control system in which the modified servomechanism 24*a* is to be incorporated can also be configured as shown in FIG. 1**.

Operation of Second Form

The operation of the constant torque control system of FIG. 4 incorporating the modified servomechanism **24*a* can, of course, be generally analogous with that of FIG. 2 except for the performance of the multiple spring means 146*a***.

The servomechanism **24*a* holds the variable displacement pump 10 at a maximum displacement in the absence of fluid pressure from the pumps 10 and 10' to the biasing pistons 126 and 128 of the control section 44. The control piston 120 of the control section 44 will travel leftwardly against the effect of the multiple spring means 146*a* upon loading of one or both of the variable displacement pumps 10 and 10'. Until the meam output pressure from the variable displacement pumps 10 and 10' builds up to $[(Pa1+Pa2)/2]_M$, the control pistion 120 will travel against the resultant of the forces of both first 148*a* and second 150*a* compression springs of the multiple spring means 146*a*, with the floating spring seat 166 moving toward the stop 168 with the compression of the springs 148*a* and 150*a***.

The floating spring seat 166 will hit the stop 168 when the control piston 120 travels leftwardly to the predetermined intermediate position upon increase of the mean output pressure of the variable displacement pumps 10 and 10' to $[(Pa1+Pa2)/2]_M$. Therefore, with a further increase in the output pressures of the variable displacement pumps 10 and 10', only the first compression spring **148*a* will be compressed to allow leftward travel of the control piston 120. The compression of the first compression spring 148*a* will continue until the mean output pressure of the variable displacement pumps 10 and 10' rises to the maximum of $[(Pa1+Pa2)/2]_H$, when the servopiston 50 of the servoactuator section 40 will strike the end cover 54 to reduce the displacement of the variable displacement pump 10 to a minimum. The predetermined intermediate position of the control piston 120, where it butts on the stop 168 as above, is readily variable by turning the adjusting screw 160 into or out of the end cover 154**.

The other details of the operation of the modified servomechanism **24*a* are considered self evident from the foregoing operational description of the servomechanism 24 of FIG. 2, with reference directed also to the graph of FIG. 3**.

Thus the modified servomechanism **24*a* also makes it possible to control the displacement of the pump 10, or pump 10', along the constant torque curve 164 of FIG. 3. In this embodiment, however, both first 148*a* and second 150***a* compression springs of the multiple spring means 146*a* resist the displacement of the control piston 120 from point LP to point MP in FIG. 3, and only the first compression spring 148*a* resists the displacement of the control piston from point MP to point HP. The multiple spring means 146*a* offers the additional advantage of a greater amount of deflection of the compression springs 148*a* and 150*a* made possible by its collinear arrangement and, consequently, of the greater accuracy with which pump displacement can be controlled.

Although the present invention has been shown and described as embodied in the constant torque control system for two variable displacement pumps, it will be understood that the invention is readily adaptable for use with one, three or more pumps. Further, while the multiple spring means 146 and 146*a* each have but two springs in the illustrated embodiment, a greater number of springs could of course be employed for controlling the displacement of a pump or pumps along a constant torque curve tangent to a correspondingly greater number of lines. These and additional adaptations or modifications of the illustrated embodiments may be restored to without departing from the scope of the present invention.

What is claimed is:

1. A constant torque control system for at least one variable displacement pump operating under a variable load, said control system consisting of a servomechanism for varying the displacement of the variable displacement pump and a fixed displacement pump supplying fluid under pressure to said servomechanism, the servomechanism comprising:

(a) a housing;

(b) a servoactuator section for acting directly on the variable displacement pump, the servoactuator section comprising:

(1) a servopiston slidably mounted in the housing so as to define a pair of opposed fluid chambers and operatively coupled to the variable displacement pump for varying the displacement thereof in response to fluid pressure supplied to the fluid chambers; and (2) resilient means acting on the servopiston for normally holding the variable displacement pump at a maximum displacement;

(c) a servovalve section for controlling communication between the fixed displacement pump and the pair of fluid chambers of the servoactuator section, the servovalve section comprising:

(1) a servovalve spool slidably mounted in the housing for selectively placing the pair of fluid chambers of the servoactuator section in and out of communication with the fixed displacement pump and with a fluid drain;

(d) a control section responsive to the variable fluid pressure from the variable displacement pump for controllably actuating the servovalve section, the control section comprising:

(1) control piston means slidably mounted in the housing for displacement in a first direction in response to the variable fluid pressure from the variable displacement pump; and (2) multiple spring means for biasing the control piston means in a second direction opposite to the first direction and normally holding the control piston means in an extreme position in the second direction, the multiple spring means comprising at least two springs adapted to vary a total spring constant thereof when the control piston means reaches a predetermined position intermediate the opposite extreme positions thereof in the first and second directions, wherein said multiple spring means comprises a first helical compression spring constantly acting on the control piston means regardless of the position of the latter relative to the housing to bias the control piston means in the second direction, a second helical compression spring arranged concentrically with the first helical compression spring and having one end butting on the control piston means, and a spring seat on which the other end of the second helical compression spring butts when the control piston means travels to the predetermined position in the first direction against the bias of the first helical compression spring, the first and second helical compression springs cojointly resisting the travel of the control piston means in the first direction past the predetermined position and means for adjustably varying the position of the spring seat of the multiple spring means toward and away from the control piston means; and (e) a control lever having a pair of opposite ends operatively engaging with the servopiston of the servoactuator section and with the servovalve spool of the servovalve section and medially pivoted to the control piston means of the control section, the control lever being effective to move the servovalve spool in response to the movement of the control piston means in order to cause displacement of the servopiston in response to fluid pressure from the fixed displacement pump, and being further effective to feed back the displacement of the servopiston to the servovalve spool, thereby controlling the displacement of the variable displacement pump in accordance with the variable fluid pressure output thereof.

2. The constant torque control system of claim 1 as adapted for controlling the displacements of a plurality of variable displacement pumps by providing one servomechanism for each variable displacement pump, the control section of each servomechanism being responsive to variable fluid pressures from all the variable displacement pumps.

3. The constant torque control system of claim 1 wherein the multiple spring means of the control section of the servomechanism comprises:

(a) said first spring constantly acting on the control piston means regardless of the position of the latter relative to the housing to bias the control piston means in the second direction; and (b) said second spring acting on the control piston means to bias the same in the second direction in coaction with the first spring when the control piston means travels to and past the predetermined position in the first direction against the force of the first spring.

4. The constant torque control system of claim 3 wherein the first and second springs of the multiple spring means are concentrically nested one within the other.

5. A constant torque control system for at least one variable displacement pump operating under a variable load, said control system consisting of a servomechanism for varying the displacement of the variable displacement pump and a fixed displacement pump supplying fluid under pressure to said servomechanism, the servomechanism comprising:

(a) a housing;

(b) a servoactuator section for acting directly on the variable displacement pump, the servoactuator section comprising:

(1) a servopiston slidably mounted in the housing so as to define a pair of opposed fluid chambers and operatively coupled to the variable displacement pump for varying the displacement thereof in response to fluid pressure supplied to the fluid chambers; and (2) resilient means acting on the servopiston for normally holding the variable displacement pump at a maximum displacement;

(c) a servovalve section for controlling communication between the fixed displacement pump and the pair of fluid chambers of the servoactuator section, the servovalve section comprising:

(1) a servovalve spool slidably mounted in the housing for selectively placing the pair of fluid chambers of the servoactuator section in and out of communication with the fixed displacement pump and with a fluid drain;

(d) a control section responsive to the variable fluid pressure from the variable displacement pump for controllably actuating the servovalve section, the control section comprising:

(1) control piston means slidably mounted in the housing for displacement in a first direction in response to the variable fluid pressure from the variable displacement pump; and (2) multiple spring means for biasing the control piston means in a second direction opposite to the first direction and normally holding the control piston means in an extreme position in the second direction, the multilple spring means comprising at least two springs adapted to vary a total spring constant thereof when the control piston means reaches a predetermined position intermediate the opposite extreme positions thereof in the first and second directions, wherein the two springs of the multiple spring means cojointly resist the travel of the control piston means in the first direction until the control piston means reaches the predetermined position, and when the control piston means travels past the predetermined position in the first direction, only one of the springs acts to resist such travel of the control piston means; and (e) a control lever having a pair of opposite ends operatively engaging with the servopiston of the servoactuator section and with the servovalve spool of the servovalve section and medially pivoted to the control piston means of the control section, the control lever being effective to move the servovalve spool in response to the movement of the control piston means in order to cause displacement of the servopiston in response to fluid pressure from the fixed displacement pump, and being further effective to feed back the displacement of the servopiston to the servovalve spool, thereby controlling the displacement of the variable displacement pump in accordance with the variable fluid pressure output thereof.

6. A constant torque control system for at least one variable displacement pump operating under a variable load, said control system consisting of a servomechanism for varying the displacement of the variable displacement pump and a fixed displacement pump supplying fluid under pressure to said servomechanism, the servomechanism comprising:

(a) a housing;

(b) a servoactuator section for acting directly on the variable displacement pump, the servoactuator section comprising:

(1) a servopiston slidably mounted in the housing so as to define a pair of opposed fluid chambers and operatively coupled to the variable displacement pump for varying the displacement thereof in response to fluid pressure supplied to the fluid chambers; and (2) resilient means acting on the servopiston for normally holding the variable displacement pump at a maximum displacement;

(c) a servovalve section for controlling communication between the fixed displacement pump and the pair of fluid chambers of the servoactuator section, the servovalve section comprising:

(1) a servovalve spool slidably mounted in the housing for selectively placing the pair of fluid chambers of the servoactuator section in and out of communication with the fixed displacement pump and with a fluid drain;

(d) a control section responsive to the variable fluid pressure from the variable displacement pump for controllably actuating the servovalve section, the control section comprising:

(1) control piston means slidably mounted in the housing for displacement in a first direction in response to the variable fluid pressure from the variable displacement pump; and (2) multiple spring means for biasing the control piston means in a second direction opposite to the first direction and normally holding the control piston means in an extreme position in the second direction, the multiple spring means comprising at least two springs adapted to vary a total spring constant thereof when the control piston means reaches a predetermined position intermediate the opposite extreme positions thereof in the first and second directions, wherein the multiple spring means comprises a floating spring seat movable relative to the housing in the axial direction of the control piston means, a first helical compression spring having one end held against the control piston means and another end held against the floating spring seat, a second helical compression spring arranged collinearly with the first helical compression spring and having one end held against the floating spring seat and another end held against a stationary part, and a stop mounted in a fixed relation to the housing, the floating spring seat moving in abutment against the stop when the control piston means travels in the first direction to the predetermined position against the forces of the first and second helical compression springs, so that only the first helical compression spring resists the travel of the control piston means in the first direction beyond the predetermined position; and (e) a control lever having a pair of opposite ends operatively engaging with the servopiston of the servoactuator section and with the servovalve spool of the servovalve section and medially pivoted to the control piston means of the control section, the control lever being effective to move the servovalve spool in response to the movement of the control piston means in order to cause displacement of the servopiston in response to fluid pressure from the fixed displacement pump, and being further effective to feed back the displacement of the servopiston to the servovalve spool, thereby controlling the displacement of the variable displacement pump in accordance with the variable fluid pressure output thereof.

7. The constant torque control system of claim 6 further comprising means for adjustably varying the position of the stop of the multiple spring means toward and away from the control piston means.

8. The constant torque control system of claim 6 further comprising a guide core projecting from the stop and extending through a hollow in the floating spring seat for guiding the movement of the floating spring seat into and out of abutment against the stop.

* * * * *